US008616288B1

(12) United States Patent
Byrne et al.

(10) Patent No.: US 8,616,288 B1
(45) Date of Patent: Dec. 31, 2013

(54) VELOCITY ANALYZER FOR OBJECTS TRAVELING IN PIPES

(76) Inventors: Paul Byrne, McKinney, TX (US); Phillip P. Harris, Perryton, TX (US)

( * ) Notice: Subject to any disclaimer, the term of this patent is extended or adjusted under 35 U.S.C. 154(b) by 402 days.

(21) Appl. No.: 12/965,559

(22) Filed: Dec. 10, 2010

Related U.S. Application Data

(60) Provisional application No. 61/285,413, filed on Dec. 10, 2009.

(51) Int. Cl.
*E21B 43/00* (2006.01)
*E21B 47/09* (2012.01)
*E21B 43/12* (2006.01)

(52) U.S. Cl.
USPC ..... 166/372; 166/255.1; 166/250.15; 166/64

(58) Field of Classification Search
USPC ..... 166/372, 255.1, 250.15, 64
See application file for complete search history.

(56) References Cited

U.S. PATENT DOCUMENTS 4,206,810 A * 6/1980 Blackman ..... 166/336
4,685,522 A * 8/1987 Dixon et al. ..... 166/372
4,989,671 A * 2/1991 Lamp ..... 166/53
5,878,817 A * 3/1999 Stastka ..... 166/372
5,957,200 A * 9/1999 Majek et al. ..... 166/250.15
6,595,287 B2 * 7/2003 Fisher ..... 166/250.15
6,634,426 B2 * 10/2003 McCoy et al. ..... 166/254.1
6,883,606 B2 * 4/2005 Evans et al. ..... 166/250.15
7,373,976 B2 * 5/2008 Casey ..... 166/250.15
7,445,048 B2 * 11/2008 Sheffield ..... 166/372
7,686,077 B2 * 3/2010 Casey ..... 166/250.03
7,806,188 B2 * 10/2010 Hearn ..... 166/372
7,819,189 B1 * 10/2010 Cosby ..... 166/255.1
2006/0054329 A1 * 3/2006 Chisholm ..... 166/372
2007/0012442 A1 * 1/2007 Hearn ..... 166/250.15
2007/0261845 A1 * 11/2007 White et al. ..... 166/250.15
2008/0029272 A1 * 2/2008 Bender ..... 166/372
2008/0164024 A1 * 7/2008 Giacomino ..... 166/255.1
2008/0202746 A1 * 8/2008 Mudry ..... 166/250.15

* cited by examiner

*Primary Examiner* — Kenneth L Thompson
*Assistant Examiner* — Michael Wills, III
(74) *Attorney, Agent, or Firm* — Tomlinson Rust McKinstry Grable

(57) ABSTRACT

A plunger lift system of an oil or gas well and method of use is described. The plunger lift system includes a plunger, a sensor, a flow valve assembly, and a controller. The plunger is positioned within the tube string and travels up and down the string in response to the opening and/or closing of the flow valve assembly. The sensor is connected to the tube string and detects vibrations generated by impacts created by the plunger temporarily catching on gaps in the tube string. The sensor generates a sensor signal in response to the impacts of the plunger which are used by the controller to determine the velocity of the plunger within the tube string. If the velocity of the plunger exceeds a preselected maximum velocity, the controller selectively opens or closes the flow valve assembly to reduce the velocity of the plunger.

28 Claims, 6 Drawing Sheets

| Configuration Jumpers Truth Table | | | | | | | | |
|---|---|---|---|---|---|---|---|---|
| Bit Enable | | | | | | | | |
| Cycle Count | 3 | 3 | 3 | 3 | 3 | 3 | 5 | 5 |
| Open Time | 1 | 2 | 2 | 3 | 3 | 3 | 1 | 2 |
| Close Time | 1 | 1 | 2 | 1 | 2 | 3 | 1 | 1 |

| Configuration Jumpers Truth Table | | | | | | | | |
|---|---|---|---|---|---|---|---|---|
| Bit Enable | | | | | | | | |
| Cycle Count | 3 | 3 | 3 | 3 | 3 | 3 | 5 | 5 |
| Open Time | 1 | 2 | 2 | 3 | 3 | 3 | 1 | 2 |
| Close Time | 1 | 1 | 2 | 1 | 2 | 3 | 1 | 1 |

Sensor Signal Waveform

VELOCITY ANALYZER FOR OBJECTS TRAVELING IN PIPES

CROSS REFERENCE TO RELATED APPLICATION

This application claims the benefit of U.S. Provisional Patent Appl. No. 61/285,413 filed on Dec. 10, 2009, the contents of which are incorporated herein fully by reference.

FIELD OF THE INVENTION

The present invention relates generally to gas wells and particularly to a plunger lift systems for use with gas wells.

BRIEF SUMMARY OF THE INVENTION

The present invention is directed to a plunger lift system for use with a gas well. The gas well comprises a tube string disposed within a well bore. The tube string comprises a plurality of tube sections having a substantially similar length and being connectable longitudinally with adjacent tube sections at a tube joint. Each tube joint comprises a gap. The system comprises a plunger, a sensor connected to the tube string, a flow valve assembly, and a controller. The plunger is positioned in the tube string to travel between a well head and a lower portion of the well bore. The sensor transmits a sensor signal each time the plunger encounters a gap as the plunger moves along the tube string. The flow valve assembly is in operable fluid communication with the tube string and is operable between an open position and a closed position to control movement of the plunger between the well head and the lower portion of the well bore. The controller is programmed to store a maximum plunger velocity, to receive the sensor signal from the sensor each time the plunger impacts the tube string at one of the plurality of gaps. The controller also determines a velocity of the plunger based on a time interval between each transmission of the sensor signal and to commands the flow valve assembly to selectively open and close to maintain the velocity of the plunger below the maximum velocity.

The present invention is also directed to a method for operating a plunger lift system for use with a gas well comprising a well bore. The method comprises determining a maximum plunger velocity and storing the maximum plunger velocity at a controller. A flow valve assembly is opened to cause movement of a plunger within a tube string. Movement of the plunger is detected as it moves along the tube string using a sensor operatively engaged with the tube string. A series of sensor signals are generated in response to detecting movement of the plunger along the tube string. Each of the sensor signals are transmitted to a controller and processed to determine a velocity of the plunger. The velocity of the plunger is compared to the maximum velocity and a command signal is automatically transmitted to the flow valve assembly to selectively close and open the flow valve assembly to maintain the velocity of the plunger at or below the maximum velocity.

DETAILED DESCRIPTION OF THE PREFERRED EMBODIMENTS

Plunger lifts are used in marginally producing wells to reduce lifting costs, conserve formation pressures, increase production, reduce water build-up, improve ease of operation, and reduce installation and operation costs. Because plunger lift systems are generally less expensive than other lift systems they have increased in popularity. However, due to the high velocity at which a plunger may ascend to the well head there is a need for improved systems and methods to control the velocity of an ascending plunger. The present invention is directed to system and method to control the ascension velocity of a plunger used in a plunger lift system.

Figure 1:
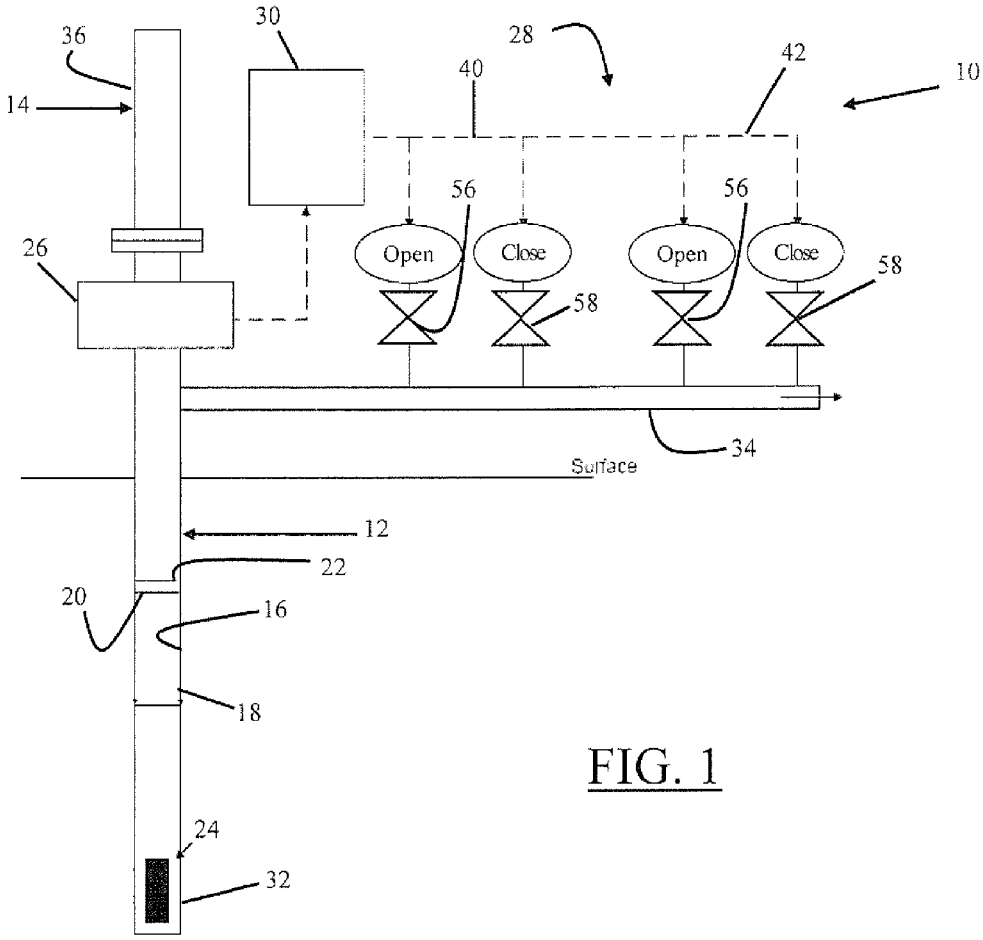
FIG. 1 is a diagrammatic representation of the plunger lift system of the present invention for use with a gas well.

Turning now to the figures, and specifically to FIG. 1. There is shown therein a plunger lift system 10 for use with a gas well 12 in accordance with the present invention. The gas well 12 comprises a well head 14, and a tube string 16 disposed within a well bore 18. One skilled in the art will appreciate that the tube string 16 may comprise a plurality of tube sections having a substantially similar length and being connectable longitudinally with adjacent tube sections at a tube joint 20. For purposes of illustration, a preferable tube section length may be thirty feet. If the tube sections are connected using a collar (not shown) each tube joint 20 may comprise a gap 22.

The lift system 10 comprises a plunger 24, a speed controller 26, a flow valve assembly 28, and a controller 30. The plunger 24 is disposed within the tube string 16 to travel between the well head 14 and a lower portion 32 of the well bore 18. A suitable plunger 24 may comprise a rod constructed from a suitable substance such as hardened steel and have dimensions of approximately 14 inches in length and a 3 inches diameter.

The surface equipment of the well comprises a commonly known well head pressure sensor to monitor (not shown) well pressure and the flow valve assembly 28 in operable fluid communication with the tube string 16. The well head pressure monitor transmits a well pressure to the controller 30 which transmits command signals to the flow valve assembly 28 when the well pressure is below a threshold well pressure. The threshold well pressure may comprise a pressure reading at which the hydrostatic pressure is equal to the gas pressure at the bottom of the well 32. When this pressure is reached the flow of gas ceases and the flow valve assembly is activated to cause the plunger 24 to descend the well bore.

The flow valve assembly 28 is operable between and open position and a closed position to control movement of the plunger 24 between the well head 14 and the lower portion of the well bore 32. When the flow valve assembly 28 is open the plunger 24 descends down the well bore 16. The flow valve assembly 28 may comprise a series of valves and piping to maximize the flow of production gas.

In operation, a control valve (not shown) at the well head closes the flow line 34 to stop the flow of fluids up through the tube string to a tank battery (not shown). A bumper housing 36 and catcher (not shown) on the well head 14 release the plunger 24 which falls under for of gravity downward through the tube string 16. When the plunger 24 reaches the bottom of the well bore 32 it effectively closes the well which causes downhole pressure build-up and also allows oil and water to accumulate on top of the plunger. After a desired time or tube pressure is reached the flow valve assembly 28 is opened to allow the gas and fluids accumulated in the tube string 16 to flow toward the surface. As the plunger 24 ascends the fluid above it is lifted to the surface. An arrival sensor (not shown) housed within speed controller 26 may be used to detect arrival of the plunger 24 at the well head 14 and to transmit an arrival signal to the controller 30. In response the controller 30 may transmit a close command to the flow valve assembly 28 until the cycle begins again.

As the plunger 24 travels past each joint 20 of the tube string 16 during its ascension it catches on each joint and causes a vibration called a PING. A sensor 38 (FIG. 2) connected to the tube string 16 is capable of detecting these PINGS and transmitting a sensor signal each time the plunger encounters a gap 22 formed by the joint 20. The gaps 22 are typically spaced apart a known distance along the tube string because each tube section has substantially the same length. Suitable sensors 38 for detecting the PINGS comprise accelerometers, acoustic transducers and microphones.

The controller 30 performs several functions important to operation of the system 10 of the present invention. The controller 30 stores a maximum plunger velocity selected by the operator and receives the sensor signal from the sensor 38 (FIG. 2) each time the plunger 24 engages the gap 20 in the tube string 16. The controller 30 comprises a processor 54 programmed to determine a velocity of the plunger 24 based upon the time interval between each transmission of the sensor signal and the known distance between each gap 22. The controller 30 further generates command signals to selectively open and close the flow valve assembly 28 to maintain the velocity of the plunger 24 below the maximum velocity.

The controller 30 controls the first 40 and second 42 valves of the flow valve assembly 28 to cause the plunger 24 to travel up and down the well.

Figure 2:
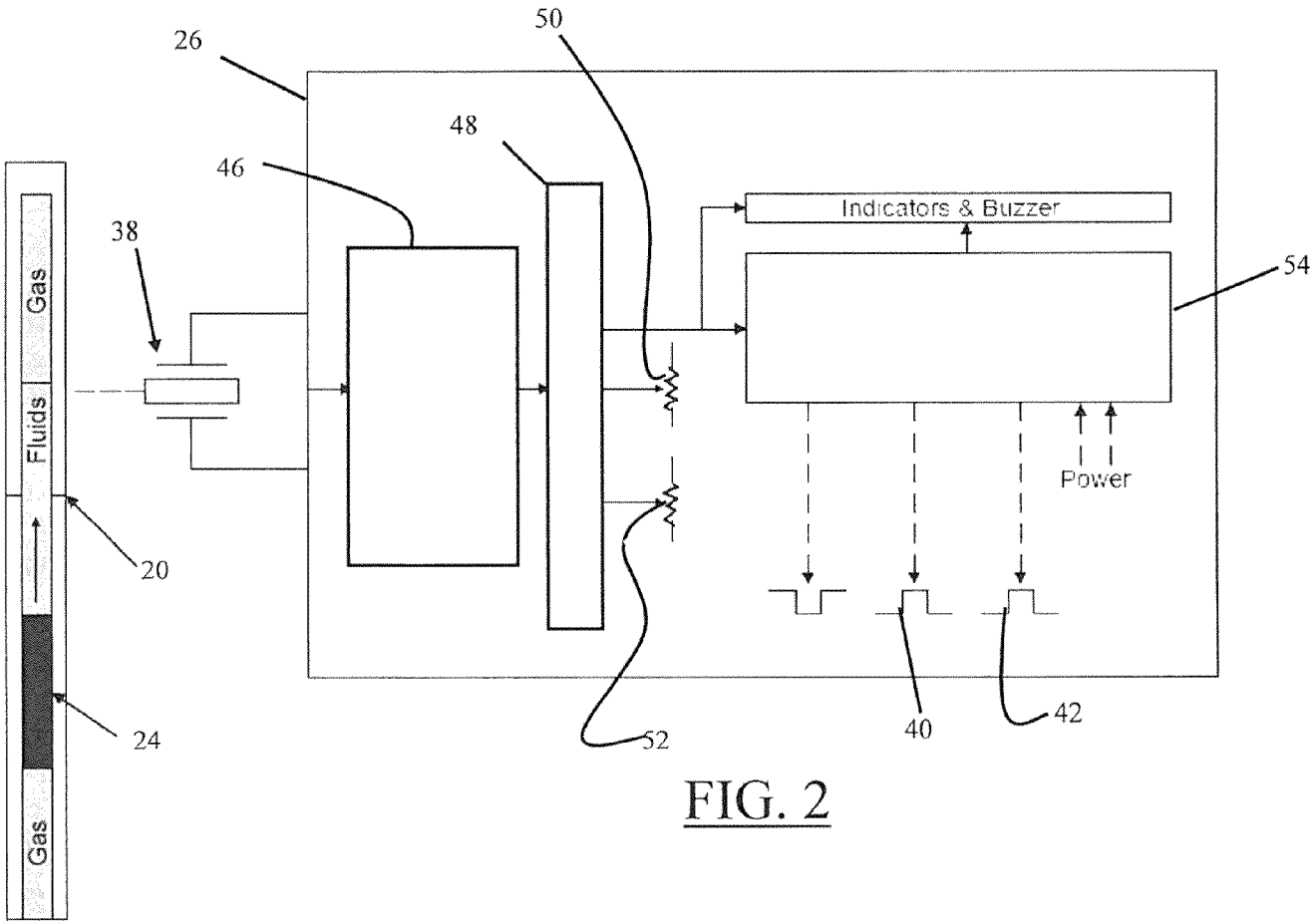
FIG. 2 is a diagrammatic representation of a controller, sensor, and plunger of the present invention.

Turning now to FIG. 2, a diagrammatic representation of a preferred controller 30 of the present invention is shown. The sensor 38 may be operatively connected to the tubing string 16 using a sensor housing clamping device (not shown).

In operation, the sensor vibrates as the plunger 24 passes each gap 22 which causes generation of a sensor signal. The sensor signal is transmitted to a signal conditioner 46 which increases the gain of the sensor signal and eliminates unwanted data. After conditioning the signal is transmitted to a filter 48 which has a variety of filter states to further reduce signal noise and unwanted data. The conditioned and filtered signal is then transmitted to a set-point adjustment potentiometer for the sensor signal 50. A set-point adjustment potentiometer for the arrival signal 52 is also provided. Potentiometers 50 and 52 allow the user to set a trip-point for the sensor signal and the arrival signal. When the sensor detects a PING of the ascending plunger, a comparison is made between the sensor signal set-point and the sensor signal's signal strength. If the strength of the sensor signal exceeds the trip-point a pulse shaping circuit produces a 50 millisecond pulse. This pulse is connected to an INTERRUPT pin on the processor 54.

In response to the pulse generated by the sensor signal, the processor 54 begins a timer that may be set to approximately 40,000 cycles per second or 40 KHz. The use of a 40 KHz processor allows the position of the plunger 24 to be determined within less that 1 mm. When the sensor 38 detects a second PING, the timer is stopped and the velocity of the plunger 24 is calculated assuming a 30 foot tube section length. If a velocity which exceeds the maximum velocity is calculated the controller 30 will take action to slow the plunger 24. The velocity of a plunger as it ascends can reach velocities of between 100 feet per minute and 1000 feet per minute. Accordingly, a maximum velocity of the plunger may be set at 400 feet per minute to reduce the likelihood of damage to the well head 14 and other surface equipment.

In order for the speed controller 26 to assist in controlling the velocity of the plunger 24, the controller 30 should communicate which flow valve 40 or 42 will be used to control flow. Returning to FIG. 1, each flow valve 40 and 42 has an open solenoid 56 and a close solenoid 58 to open and close each valve. One skilled in the art will appreciate that the flow valves 40 and 42 may comprise a motor valve such as a butterfly valve. When the controller 30 selects flow valve 40 or 42, it transmits this data to the speed controller 26 which it logs into its memory. Once the flow valve set 40 or 42 has been chosen, the speed controller begins to monitor for the sensor signal from the sensor 38 (FIG. 2).

Figure 3:
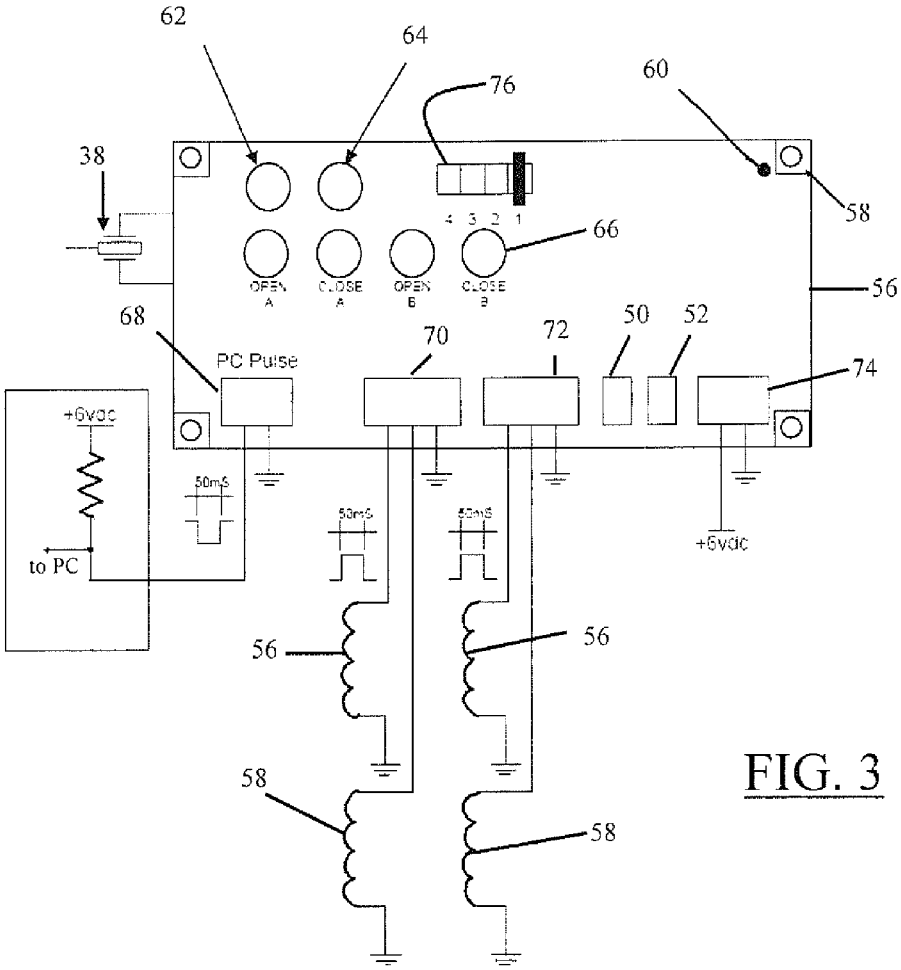
FIG. 3 provides a more detailed diagrammatic representation of the controller of FIG. 1.

Turning now to FIG. 3, there is shown therein a diagrammatic representation of the speed controller 26. The speed controller 26 is operatively connected to the sensor 38. The speed controller 26 comprises a frame 56 to support multiple visual display indicators and associated electronics. The frame 56 may have multiple mounting holes 58 spaced about its periphery and a grounding post 60. The visual display indicators may comprise a sensor signal light emitting diode ("LED") 62, an arrival signal LED 64 to communicate receipt of the arrival signal, and a plurality of flow valve LEDs 66.

The associated electronics comprise a controller pulse circuit 68, a first flow valve control circuit 70, a second flow valve control circuit 72, the previously described sensor signal potentiometer 50 and arrival signal potentiometer 52, and a power supply 74. The first flow valve control circuit 70 controls the transmission of open and close command signals to the first flow valve open and close solenoids 56 and 58. The second flow valve control circuit 72 controls the transmission of open and close command signals to the first flow valve open and close solenoids 56 and 58. The power supply 74 receives +6 vdc power from the controller 30.

After the controller 30 selects the first or second flow valve 40 or 42, the speed controller 26 stores this information as the Default Valve Set. When the controller 30 activates the selected open solenoid 56, the speed controller 26 begins to monitor the sensor 38 for transmission of the sensor signal. When the circuit detects a valid sensor signal, the processor 54 (FIG. 2) activates a timing sequence. Because the circuit used to detect the sensor signal operates independently from the processor 54, the condition of the system may be constantly monitored.

When a valid sensor signal is detected, the sensor signal LED 62 blinks for 50 milliseconds and the timer of the processor 54 is started. When a second sensor signal is detected and the sensor signal LED 62 is pulsed again for 50 milliseconds, the timer is stopped. The processor 54 then determines the velocity of the plunger 24 based on the time interval between each transmission of the sensor signal and compares the determined velocity value to the stored maximum velocity to determine if the plunger 24 is traveling in excess of the maximum velocity.

Figures 3A, 3B:
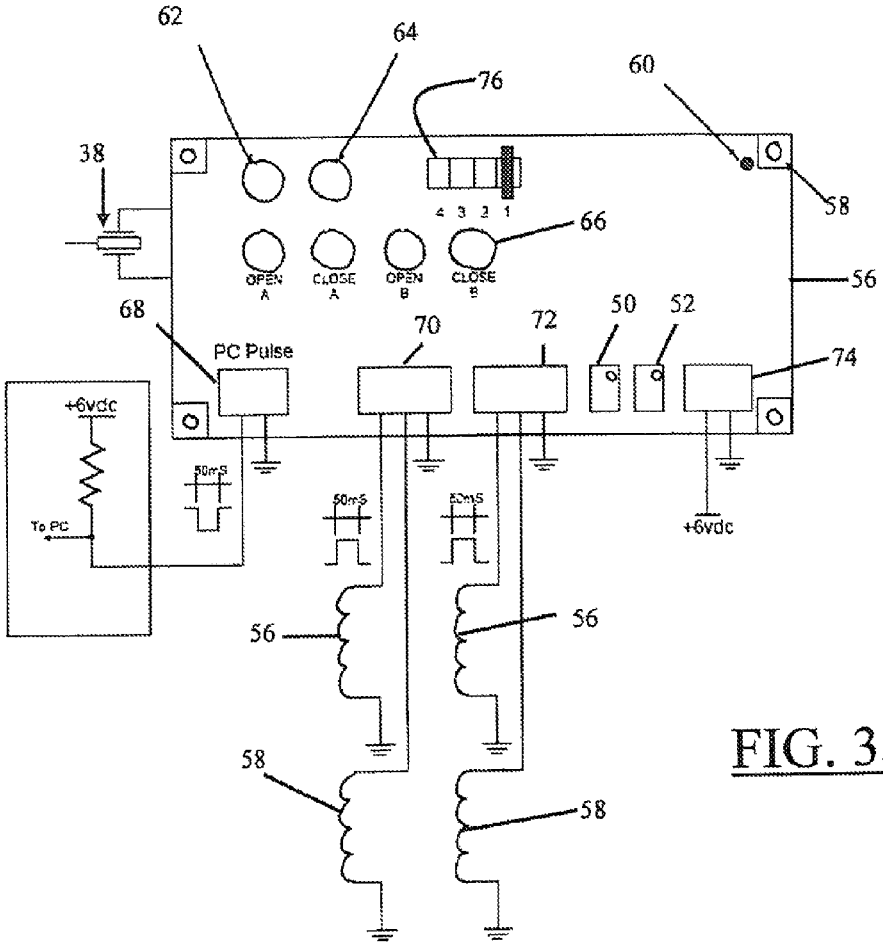

If the plunger velocity exceeds the maximum velocity, for purposes of illustration 400 feet per minute, the processor 54 activates a valve cycle. The valve cycle is determined by configuration jumpers 76 supported on the speed controller 26. A configuration jumper truth table is shown in FIG. 3*b*. The default valve cycle may comprise the following valve sequence: (1) the selected flow valve close solenoid 58 is activated to close the Default Valve Set for 3-seconds. This reduces the velocity of the plunger 24 by shutting-in the well and not allowing production gas to flow. Next, the selected flow valve open solenoid 56 is activated to open the Default Valve Set for 1-second. The close solenoid 58 is re-activated to close the Default Valve Set for 1-second. In an embodiment of the present invention, the valve cycle is repeated for 3-cycles placing 1-second between each cycle.

Upon conclusion of the valve cycle, the speed controller 26 returns to monitoring the plunger's velocity by detecting and analyzing the sensor signals from the sensor 38. If the plunger velocity is determined to exceed the maximum selected velocity, the valve cycle discussed above is repeated.

The result of such analysis and valve cycle is that the plunger velocity is maintained at or below 400 feet per minute to facilitate non-violent docking of the plunger 24 at the well head 14.

Figure 4:
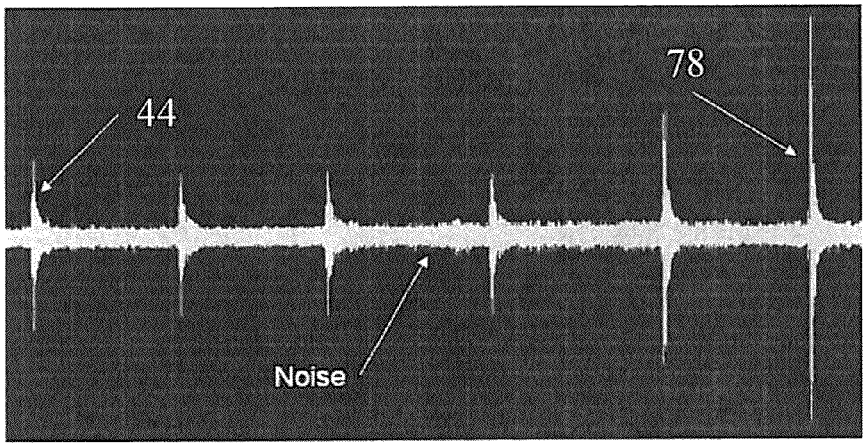
FIG. 4 is a waveform showing the sensor signals and an arrival signal.
Figure 5A:
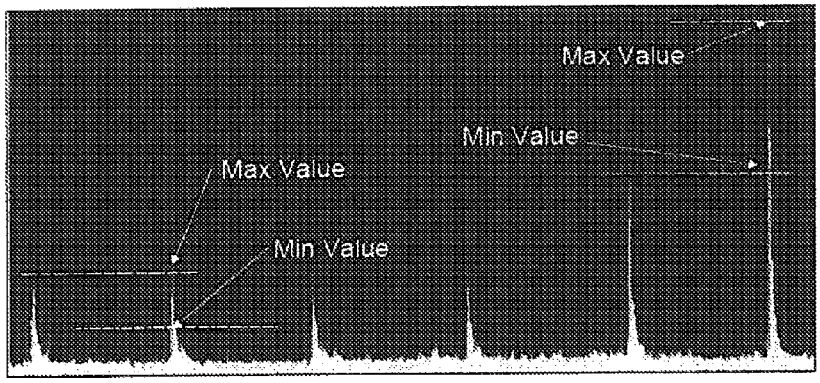
FIG. 5 shows the sensor signal and arrival signal in analog form from the sensor and the arrival sensor, respectively and the fully conditioned digital signal transmitted to a processor used in accordance with the present invention.
Figure 5B:
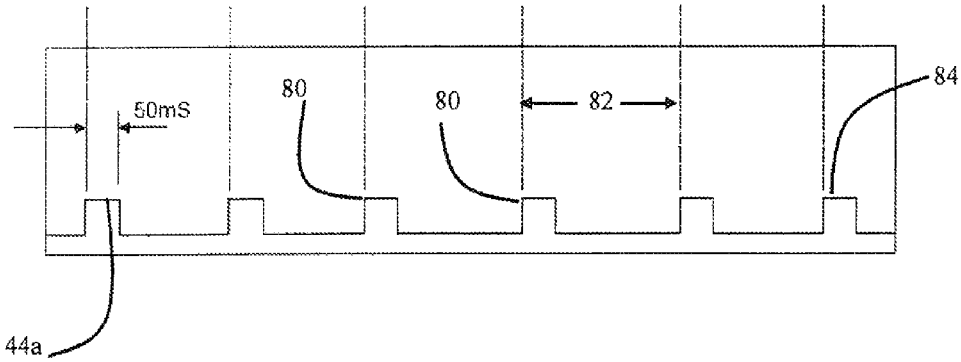

The arrival, signal generated from the arrival sensor upon the plunger 24 docking with a well head 14 is usually larger than the sensor signal detected as the plunger catches the gaps in the tube string 16. An illustration of the sensor signal and the arrival signal are shown in FIGS. 4, 5*a*, & 5*b*. FIG. 4 shows a series of sensor signals 44 that have not been conditioned or filtered and that are in analog form. FIG. 4 also shows an arrival signal 78 having amplitude greater than the amplitude of the sensor signals 44. FIG. 5*a* shows the series of analog sensor signals 44 and an arrival signal 78 after they have been conditioned and filtered. FIG. 5*b* shows the series of sensor signals 44*a* and the arrival signal 78*a* after the signals have been fully conditioned and converted to 50 millisecond pulses. These signals are then passed to the processor 54 for use in determining the velocity of the plunger 24. The processor 54, as described above, measures the time between the start 80 of a sensor signal 44*a* to the start of an adjacent sensor signal along with the know length between each gap to determine the velocity of the plunger 24. The time interval is referred to using reference number 82 in FIG. 5*b*.

When an arrival pulse 84 is detected, the arrival LED 64 (FIG. 3) is illuminated. The processor 54 then activates an arrival cycle and a 50 millisecond pulse is sent to the controller 30 to announce arrival of the plunger 24. The speed controller 24 waits for a preselected period, for purposes of illustration 5 minutes is used, to allow the controller 30 to continue its operations. One skilled in the art will appreciate that this waiting period may be adjusted by the user. When the wait period runs the speed controller 26 monitors the status of the open valve solenoids 56 and ignores and sensor signals received by the speed controller 26. This feature allows the plunger 24 to descend back down to the lower portion of the well 32. If the controller 30 determines the plunger 24 should be activated a valve open pulse will be transmitted to the Default Valve Set. The speed controller 26 detects transmission of this pulse, and stores the Default Valve Set in memory and activates the sensor's monitoring circuitry. The cycle discussed above then repeats.

The present invention is also directed to a method for operating the plunger lift system 10 to lift and lower the plunger 24 within the gas well comprising the well bore 18. The method comprises determining a maximum plunger velocity and storing the maximum plunger velocity at the controller 30. The flow valve assembly 28 is opened to cause movement of the plunger 24 within the tube string 16. Opening the flow valve assembly 28 generally causes the plunger 24 to ascend within the tube string 16. Movement of the plunger is detected using the sensor 38 operatively engaged with the tube string 16 as the plunger moves along the tube string. A series of sensor signals 44 (FIGS. 4 and 5) are generated in response to the sensor 38 detecting movement of the plunger 24 along the tube string 16. Each of the sensor signals 44 are transmitted to the speed controller 26 for conditioning, filtering, and conversion to 50 millisecond pulses 44*a*. The sensor signals 44 are conditioned to increase the gain of each signal and filtered to reduce noise.

The pulses 44*a* are processed to determine a velocity of the plunger 24. The determined velocity of the plunger 24 is compared to the stored maximum velocity and a command signal is automatically transmitted to the flow valve assembly 28 to selectively close or open the flow valve assembly 28 to maintain the velocity of the plunger at or below the maximum velocity.

In accordance with the method of the present invention, movement of the plunger 24 as it moves along the tube string 16 may comprises detecting an impact of the plunger caused by the plurality of substantially equally spaced-apart gaps 22 formed in the tube string 16. The sensor 38 used to detect the impacts of the plunger 24 against the tube string 16 may comprise an accelerometer adapted to detect vibrations caused by the plunger's impact on the tube string at each of the plurality of gaps as the plunger ascends the tube string. The distance between each gap may be between 29 and 31 feet and preferably is approximately 30 feet.

Upon arrival of the plunger 24 at the well head 14, an arrival signal is transmitted to the controller 30 and a close command may be transmitted to the flow valve assembly 28 in response to the arrival signal. Receipt of the arrival signal by the controller 30 causes the controller to send an close command signal to the flow valve assembly 28 to cause the selected flow valve assembly 40 or 42 to close and further cause the plunger 24 to return to the lower portion of the well 32.

As shown in the figures, the flow valve assembly 28 may comprise a first valve set 40 and a second valve set 42. Accordingly, the close and open command signals from the controller 30 may be send to the flow valve assembly to selectively close or open one of the first valve set 40 or the second valve set 42 to the exclusion of the unselected valve set.

Selective opening and closing of the flow valve assembly 28 may comprise closing the flow valve assembly for three (3) seconds; opening the flow valve assembly for one second; thereafter, closing the flow valve assembly for one second; and repeating the sequence for three (3) cycles with one second between each cycle.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A plunger lift system for use with a gas well, the gas well comprising a well head and a tube string disposed within a well bore, the tube string comprising a plurality of tube sections having a substantially similar length and being connectable longitudinally with adjacent tube sections at a tube joint, wherein each tube joint comprises a gap, the system comprising:

a plunger positioned in the tube string to travel between the well head and a lower portion of the well bore;

a sensor that detects vibration, connected to the tube string, to transmit a sensor signal each time the plunger encounters a gap that detects vibrations as the plunger moves along the tube string;

a flow valve assembly in operable fluid communication with the tube string, wherein the flow valve assembly is operable between an open position and a closed position to control movement of the plunger between the well head and the lower portion of the well bore; and a controller comprising a sensor signal potentiometer, programmed to store a maximum plunger velocity, to receive the sensor signal from sensor each time the plunger engages the gap, to determine a velocity of the plunger based on a time interval between each transmission of the sensor signal, and to command the flow valve assembly to selectively open and close to maintain the velocity of the plunger below the maximum velocity.

2. The plunger system of claim 1 wherein the sensor comprises an accelerometer.

3. The plunger system of claim 1 wherein the sensor comprises an acoustic transducer.

4. The plunger system of claim 1 further comprising an arrival sensor to detect arrival of the plunger at the well head and to transmit an arrival signal to the controller, wherein the controller transmits a close command to the flow valve assembly.

5. The plunger system of claim 1 wherein the flow valve assembly comprises a first flow valve in operable communication with the tube string and a second flow valve in operable communication with the tube string.

6. The plunger system of claim 1 further comprising a well head pressure sensor to monitor well pressure and to transmit a well pressure to the controller, wherein the control transmits a close command signal to the flow valve assembly when the well pressure is below a threshold well pressure.

7. The plunger system of claim 4 wherein the controller comprises a visual display to communicate receipt of the arrival signal by the controller.

8. The plunger system of claim 1 further comprising a visual display and/or an auditory signal generator to communicate receipt of the sensor signal by the controller.

9. The plunger system of claim 1 further comprising an arrival signal potentiometer.

10. The plunger system of claim 1 wherein the maximum velocity is between 100 feet per minute and 1000 feet per minute.

11. The plunger system of claim 1 wherein the maximum velocity is 400 feet per minute.

12. The plunger system of claim 1 wherein the controller comprises a 40 KHz processor to determine the velocity of the plunger based on the time interval between each transmission of the sensor signal.

13. A method for operating a plunger lift system to raise and lower a plunger within a well bore of a gas well, the method comprising:

determining a maximum plunger velocity and storing the maximum plunger velocity at a controller;

opening a flow valve assembly to cause movement of the plunger within a tube string;

detecting movement of the plunger as it moves along the tube string using a sensor connected to the tube string, wherein the sensor detects a vibration of the tube string caused by the plunger impacting the tube string;

generating a series of sensor signals in response to detecting the vibration of the tube string;

transmitting each of the sensor signals to a speed controller;

processing the sensor signals to determine a velocity of the plunger;

comparing the velocity of the plunger to the maximum velocity; and automatically transmitting a command signal to the flow valve assembly to selectively close and open the flow valve assembly to maintain the velocity of the plunger at or below the maximum velocity.

14. The method of claim 13 wherein detecting movement of the plunger as it moves along the tube string comprises detecting an impact of the plunger caused by a plurality of substantially equally spaced-apart gaps formed in the tube string.

15. The method of claim 14 wherein the tube string comprises a plurality of tube sections connected end-to-end using a collar and wherein the longitudinally spaced-apart gaps are formed by the connection of adjacent tube sections.

16. The method of claim 13 wherein the sensor comprises an accelerometer and wherein detecting movement of the plunger comprises detecting the vibration with the accelerometer, wherein the vibration is caused by the plunger impacting the tube string at each of a plurality of gaps formed in the tube string as the plunger ascends the tube string.

17. The method of claim 16 wherein the distance between each gap is between 29 and 31 feet.

18. The method of claim 16 wherein the distance between each gap is 30 feet.

19. The method of claim 13 further comprising receiving the sensor signals at the speed controller and conditioning each signal as it is received to increase the gain of each sensor signal.

20. The method of claim 19 further comprising filtering the sensor signal to reduce signal noise.

21. The method of claim 13 further comprising establishing a trip-point for the sensor signal.

22. The method of claim 13 further comprising transmitting an arrival signal to the controller when the plunger reaches the well head.

23. The method of claim 22 further comprising transmitting a close command to the flow valve assembly in response to the arrival signal.

24. The method of claim 13 wherein the flow valve assembly comprises a first valve set and a second valve set, wherein selectively closing and opening the flow valve assembly comprises sending a command signal from the controller to one of the first valve set or the second valve set.

25. The method of claim 13 further comprising shaping the sensor signal to generate a 50 millisecond pulse.

26. The method of claim 13 wherein selectively closing and opening the flow valve assembly comprises:

(a) closing the flow valve assembly for 3 seconds;

(b) opening the flow valve assembly for one second;

(c) thereafter, closing the flow valve assembly for one second; and (d) repeating b and c for three cycles with one second between each cycle.

27. The method of claim 13 comprising closing the fio valve assembly to move the plunger to a lower portion of the well bore.

28. The method of claim 22 further comprising activating a visual display means upon receipt of the arrival signal by the controller and opening the flow valve assembly to allow the plunger to descend to a lower portion of the well bore.

* * * * *

UNITED STATES PATENT AND TRADEMARK OFFICE

CERTIFICATE OF CORRECTION

PATENT NO. : 8,616,288 B1
APPLICATION NO. : 12/965559
DATED : December 31, 2013
INVENTOR(S) : Byrne et al.

It is certified that error appears in the above-identified patent and that said Letters Patent is hereby corrected as shown below:

In the Claims

Column 8, claim 27, line 56, please delete "fio" and substitute therefore --flow--.

Signed and Sealed this
Twenty-ninth Day of April, 2014

Michelle K. Lee

Michelle K. Lee
*Deputy Director of the United States Patent and Trademark Office*